United States Patent [19]

Weikert

[11] 4,265,279

[45] May 5, 1981

[54] PACKAGE FOR MAINTAINING ASEPSIS OF A STERILE WEB OF BAGS AND METHOD OF USING

[76] Inventor: Roy J. Weikert, 2000 Schlater Dr., Sidney, Ohio 45365

[21] Appl. No.: 64,304

[22] Filed: Aug. 6, 1979

[51] Int. Cl.[3] ..... B65B 55/04

[52] U.S. Cl. ..... 141/10; 53/426; 53/167; 141/98; 206/204; 206/603

[58] Field of Search ..... 53/426, 167, 434; 141/1, 10, 35, 36, 98, 114, 313-317, 325, 329, 330; 206/603, 204; 229/69

[56] References Cited

U.S. PATENT DOCUMENTS

| | | | |
|---|---|---|---|
| 4,021,283 | 5/1977 | Weikert | 53/434 X |
| 4,171,604 | 10/1979 | Weikert | 53/426 |

*Primary Examiner*—Frederick R. Schmidt
*Attorney, Agent, or Firm*—Biebel, French & Nauman

[57] ABSTRACT

A package of book-like shape having three leaves is used for maintaining asepsis of a sterile web of bags during web transfer or start up. Each of the leaves contains an absorbant layer to which a sterilizing medium such as hydrogen peroxide can be applied. The two outer leaves also carry anvil plates and a curved knife blade is positioned on one of the anvil plates, either as part of the original package or just prior to use. Where a transfer is to be made from the expiring end of a web of bags to a new web of bags, the package is applied with the central leaf, carrying a sterilizing agent, interposed between opposing surfaces of the expiring and new webs of bags. One of the outer leaves is positioned on an outer surface of the new web of bags and the other outer leaf is positioned on the outer surface of the expiring web of bags. Thereafter pressure is applied to the entire assembly, causing the knife blade to pierce through all of the layers between the two anvil plates. This provides a passage for a filling nozzle, permitting it to transfer from the expiring web of bags to the new web of bags while the sterility of the webs is maintained. At start-up the procedure is similar, except that in place of an expiring web of bags a sterilizing boot will have been placed about the filling nozzle and filled with steam or some other sterilizing agent. Thereafter the same process is carried out using the same package, except that corresponding surfaces of the boot are substituted for the surfaces of an expiring web of bags.

11 Claims, 12 Drawing Figures

PACKAGE FOR MAINTAINING ASEPSIS OF A STERILE WEB OF BAGS AND METHOD OF USING

BACKGROUND OF THE INVENTION

1. Field of the Invention

The present invention relates to means for maintaining the sterility of a packaging line during start-up or web transfer, and more particularly, to means for providing a sterilized splice between an expiring web of sterile tubing and a new web of sterile tubing or between a sterilizing boot and a web of sterile tubing at start-up.

2. Prior Art

U.S. Pat. No. 4,021,283, May 3, 1977, discloses a method of making aseptic packaging. As disclosed in this patent a continuous, blown film tube of plastic material is formed under aseptic conditions, flattened, and thereafter provided with a series of regularly spaced transverse seals which extend from one edge of the flattened tube to a point short of the opposite edge to form a channel along that edge to receive a filling nozzle. By sterilizing the filling nozzle prior to its insertion in the web of tubing, and also sterilizing the product to be packaged, aseptic conditions are maintained within the bags, which are thereafter filled and sealed without being opened to the atmosphere. In the case of food products, for example, this provides a greatly increased shelf life.

U.S. Pat. application Ser. No. 886,921, filed Mar. 15, 1978, now U.S. Pat. No. 4,171,604, is directed to a method for maintaining the asepsis of a web of bags such as that shown in U.S. Pat. No. 4,021,283 during start-up and transfer from one web of bags to another. In accordance with the method disclosed in the above-noted application, a flexible boot is attached about the filling nozzle prior to commencement of the packaging operation and the nozzle is thoroughly sterilized by the introduction of steam or some other sterilizing agent into the boot. After the nozzle has been sterilized an absorbant pad is positioned between a surface of the boot and an opposing surface of the leading end of a web of packaging material to sterilize these opposing surfaces. The nozzle is provided with a special fitting which then allows the nozzle to pierce through the opposing surfaces of the boot and the leading end of the web of bags. This permits the nozzle to be introduced into the web of bags under aseptic conditions.

When the initial web of bags is expended a new web of bags is brought into the packaging machine in a similar manner. Thus, a pad of absorbant material containing a sterilizing medium such as hydrogen peroxide is interposed between the opposing surfaces of the trailing end of the expiring web of bags and the leading end of the new web of bags, and once again using the special attachment on the filling nozzle, a hole is punctured through the opposing surfaces of the two webs of bags, allowing the nozzle to pass under aseptic conditions from the old web into the new one.

While the system described above maintains the sterility of a web of bags as it is introduced into the filling line, it will be apparent that the individual fabrication and application of a pad of absorbant material each time a start-up or transfer is made and the use of a special piercing nozzle assembly can be both time consuming and expensive.

SUMMARY OF THE INVENTION

The present invention provides a package for maintaining the sterility of a web of bags as it is fed into the filling system, both at start-up and during the transfer from an expiring web of bags to a new web of bags, and without the necessity of a special piercing nozzle.

More specifically, in accordance with the present invention a package is provided which is of book-like form having three leaves or sheets. The outer sheets may be formed of a single sheet having one surface covered with a pressure-sensitive adhesive and folded in half so that its adhesive covered surface faces inwardly. Of course, the outer sheets can also be formed as two separate sheets of material each having an inner surface covered with a pressure-sensitive adhesive.

Mounted on the adhesive covered surface of each of the outer sheets is an anvil plate formed of a relatively harder material, such as a tough nylon or a high density polyethylene, and covered with a layer of absorbant material. Cover sheets cover both the layers of absorbant material and the pressure-sensitive, adhesive coated surfaces of the outside sheets to prevent them from sticking together.

The center sheet or leaf of the package is comprised basically of a layer of absorbant material bordered on at least three sides by a double-faced, pressure-sensitive adhesive tape or similar material, which has both of its adhesive surfaces covered by cover sheets to prevent adhesion to the outer sheets.

A curved knife is included in the package adhered to one of the anvil plates by a strip of double faced pressure sensitive tape and covered by a layer of absorbant material that covers that anvil plate. Of course, the knife may be reusable and inserted in the appropriate place in the package just prior to use or it may be of relatively inexpensive construction so that each package comes equipped with a disposable knife.

In use the cover sheet is peeled off the inner surface of a first one of the outer sheets, exposing the absorbant layer overlying the anvil plate adhered to that outer sheet, and a sterilizing agent such as hydrogen peroxide is applied to the absorbant layer. The exposed, adhesive coated inner surface of the outer sheet with the absorbant layer carrying the sterilizing agent is then applied to an outer surface of the leading end of a new web of bags adjacent its upper corner.

To facilitate this operation the outer surface of the first one of the outer sheet may be provided with a strip of double-faced, pressure-sensitive adhesive tape which permits the package to first be adhered to a work plate mounted in a convenient position along the filling line and then the leading end of the new web applied to the inner surface of that outer sheet.

Next the cover sheets on the adhesive covered tape forming a frame around the middle absorbant layer of material on the side facing the leading end of the new web are removed and a sterilizing medium is applied to the absorbant material. The adhesive tape forming the frame for the middle absorbant layer is then adhered to the surface (hereinafter referred to as the "inner surface") of the leading end of the new web of bags opposite the surface to which the outer sheet had previously been applied.

Next the cover sheets on the opposite side of the frame around the middle absorbant layer are removed and a surface (hereinafter referred to as the "inner surface") of the trailing end of the expiring web of bags is pressed into engagement with it at a point on the trailing end of the expiring web of bags adjacent its upper corner. Following this the cover sheet is removed from the second outer sheet and the absorbant layer carried by this second outer sheet is supplied with a sterilizing material such as hydrogen peroxide.

If the package does not have a blade installed, prior to applying the sterilizing material to the absorbant layer the absorbant material is lifted slightly from the adhesive covered surface of the outer cover sheet to permit the curved blade to be inserted between the absorbant layer and the anvil plate carried by the cover sheet. With a knife blade in place and the absorbant layer overlying the knife blade carrying a sterilizing agent, the second outer sheet is folded over the top of the trailing end of the expiring web and adhered to the outer surface of that web.

Next, the entire assembly, that is, the two webs of packaging material and the three sheets of the package together with the associated anvil plates, sheets of absorbant material and knife are clamped in any convenient type of clamping device, causing the knife to pierce first through the absorbant layer of material overlying the knife, then through the outer surface of the trailing end of the expiring web, then through the inner surface of the trailing end of the expiring web, next through the central absorbant layer of the package, then through the inner surface of the leading end of the new web of bags, next through the outer surface of the leading end of the new web of bags and finally, through the absorbant layer of material overlying the anvil on the first outside sheet of the package.

When this operation has been accomplished the smooth, tapered end of the filling nozzle will pass readily through the aligned incisions formed in the opposed inner surfaces of the leading and trailing ends of the new and expiring webs of bags, respectively. The outer sheet and anvil plate of the package overlying the outer surface of the leading end of the new web of bags prevents the nozzle from passing through the cut formed through the outer surface of the leading end of the new web of bags.

It should also be noted that preferably the apex of the curved knife should be placed as nearly as possible coincident with the downstream edge of the transverse seal closing the end of the expiring web of bags. This greatly facilitates passage of the nozzle from the expiring web into the new web by preventing the formation of a pocket at the end of the expiring web in which the nozzle end might become engaged if the incision through the inner surface of the trailing end of the expiring web was spaced downstream from the edge of the transverse seal at the end of the expiring web.

The above description is specific with respect to the transfer from an expiring web to a new web. The same general conditions apply where the transfer is from a sterilizing boot at start-up to the initial web of bags. The only difference being that instead of the package being applied to a trailing end of an expiring web of bags it is applied to the upstream end of a sterilizing boot.

DESCRIPTION OF THE PREFERRED EMBODIMENTS

Figure 1:
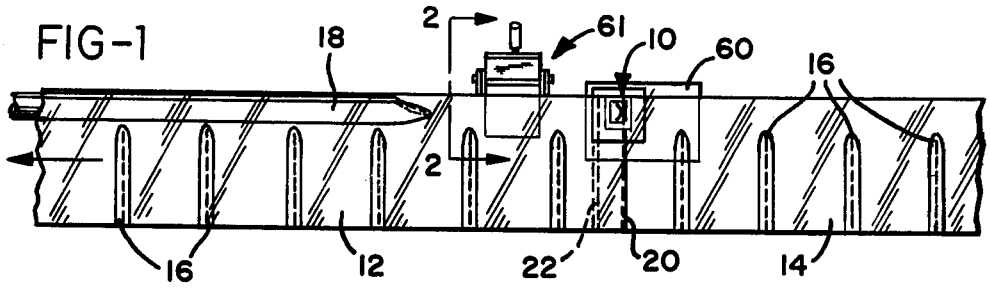
FIG. 1 is an overall view of a splicing operation in accordance with the present invention.

FIG. 1 of the drawings shows the package 10 of the present invention as it would be applied to the trailing end of an expiring web 12 of tubular material and the leading end of a new web 14 of tubular material. The webs 12 and 14 can be of the type described in the above noted U.S. Pat. No. 4,021,283 and are formed of flattened tubes of low density polyethylene or the like having transverse seals 16 which extend from their lower edges to a point short of their upper edges to form a continuous channel along the upper edge of the web to receive a filling nozzle 18. Each of the webs 12 and 14 are formed with sterile interiors and to preserve the sterility the trailing edge of the web 12 is sealed, as at 20, and the leading edge of the web 14 is sealed, as at 22.

Figure 4:
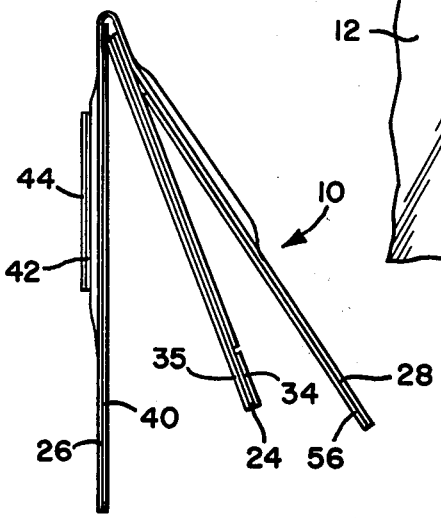
FIG. 4 is an end view of the package showing the three leaves or sheets thereof in an expanded position.

Turning next to FIG. 4 of the drawings, it will be seen that the package 10 includes an inner sheet 24 and outer sheets 26 and 28, respectively. Outer sheets 26 and 28 can be formed as, and in fact are shown as, a single sheet of paper or similar material folded in half, although it will be apparent that they could be separate sheets attached to each other and the upper end of sheet 24 to provide the book-like configuration shown in FIG. 4 of the drawings.

Figure 7:
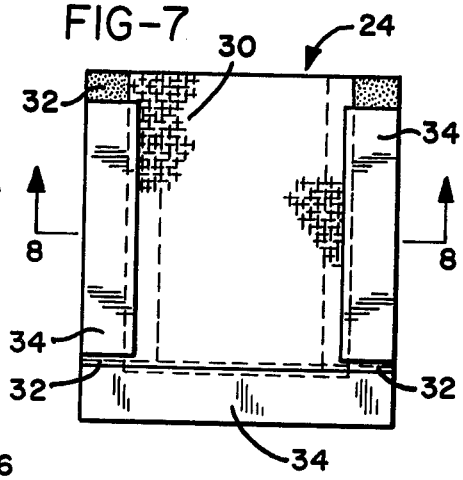
FIG. 7 is a side view of the inner sheet of absorbent material of the package of the present invention with the other members removed.
Figure 8:
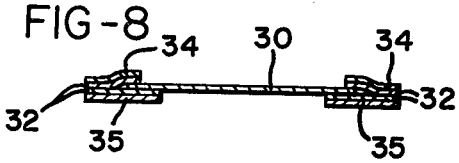
FIG. 8 is a cross sectional view taken along line 8—8 of FIG. 7.

Considering FIGS. 4, 7 and 8 together it will be seen that the inner sheet 24 includes a layer 30 of absorbant material which may, for example, be an absorbant paper material such as paper toweling or blotter paper. Layer 30 is framed on three sides by strips of double faced pressure sensitive adhesive tape 32 which is covered by cover strips 34 and 35.

Figure 5:
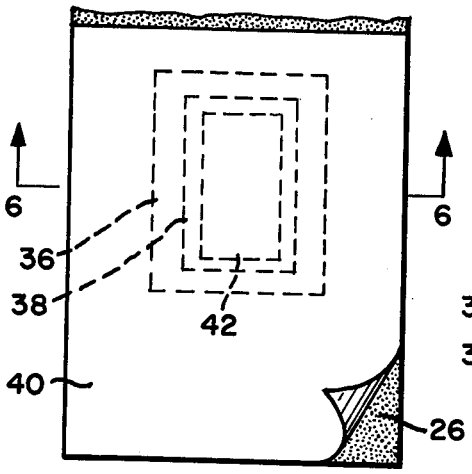
FIG. 5 is a side view of an outer sheet of the package with the other portions of the kit removed.
Figure 6:
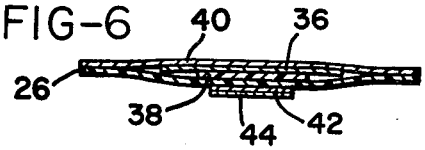
FIG. 6 is a cross sectional view taken on line 6—6 of FIG. 5.

The inside surface of the first outer sheet 26, as seen in FIGS. 4, 5 and 6 of the drawings, is covered with a pressure sensitive adhesive and has adhered to its face a pad 36 of absorbant material similar to the material 30. Interposed between a portion of the pad 36 and the sheet 26 is an anvil plate 38 made of material much harder than the materials from which the bags 12 and 14 and the layers 24, 26 and 28 are made. A cover sheet 40 overlies the entire face of the sheet 26, and attached to an outer surfacce of the cover sheet 40 is a strip 42 of double faced pressure sensitive adhesive tape covered by a cover strip 44.

Figure 9:
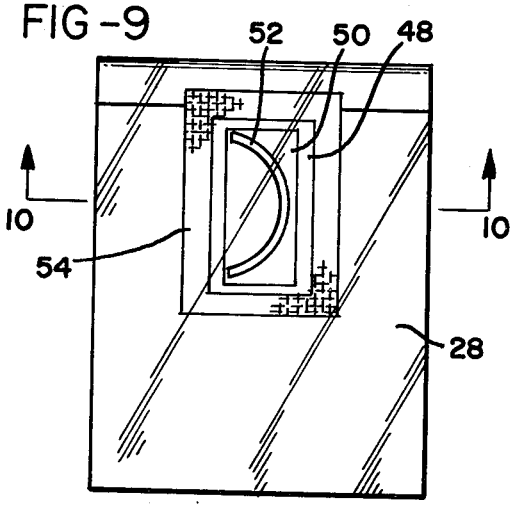
FIG. 9 is a side view of a second outer sheet of the package with the other portions of the package removed.
Figure 10:
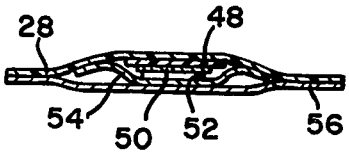
FIG. 10 is a cross sectional view taken along line 10—10 of FIG. 9.

FIGS. 4, 9 and 10 show the second outer sheet 28. Sheet 28, similarly to sheet 26, has its inner face covered with a pressure sensitive adhesive. Adhered to the inner face of the sheet 28 is an anvil plate 48 which, similarly to anvil plate 38 is formed of a material substantially harder than that of either of the webs 14 or the sheets 24, 26 and 28. A strip of double faced pressure sensitive tape 50 is adhered to one face of the anvil plate 48 and a curved knife 52 is adhered to the tape 50. Overlying the knife 52 is a layer of absorbant material 54, which may be of the same material as layers 30 and 36. A cover sheet 56 then covers the entire assembly.

Figure 12:
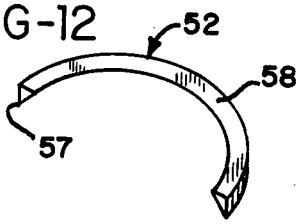
FIG. 12 is a perspective view of a knife blade of the present invention.

Knife 52, as can be best seen in FIG. 12, is of substantially triangular cross sectional configuration and includes a cutting edge 57 and an opposite, substantially flat edge 58. It is the flat edge 58 that is adhered to the face of the strip 50.

Figure 3:
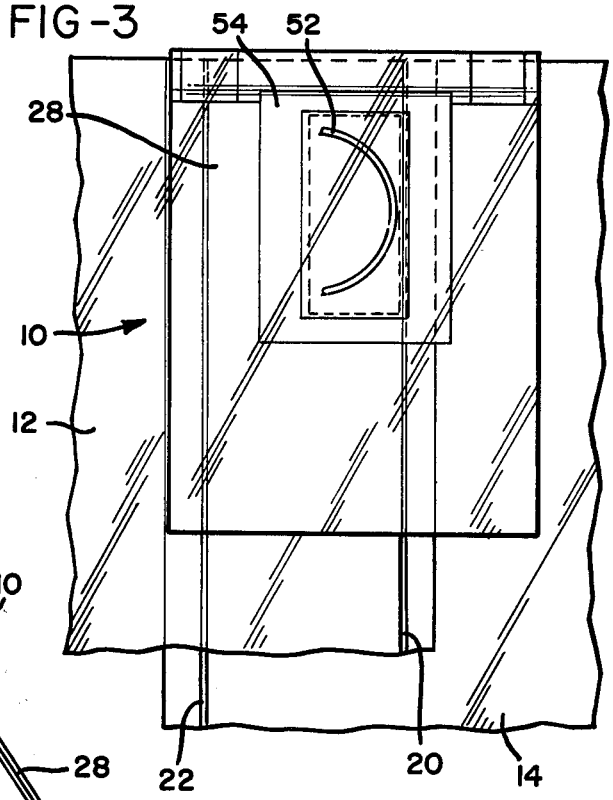
FIG. 3 is an enlarged view of a portion of FIG. 1.

In use the cover strip 44 is peeled from the outer face of the strip of double faced pressure sensitive adhesive tape 42 and the package is stuck to a stationary plate 60 which, as seen in FIG. 1, is mounted at a convenient position adjacent the end of the filling nozzle 18. Next the leading end of the new web of bags 14 is brought into position and the cover sheet 40 is removed from the first outer sheet and the upper leading end, the upper left hand corner as seen in FIG. 3 of the drawings, of the web 14 is applied to the adhesive covered surfaces of the sheet 26. Prior to this the layer 36 is treated with a sterilizing agent such as hydrogen peroxide so that the sheet acts as a sterilant in contact with an outer surface of the new web.

Next the cover strips 35 are removed from the inner sheet 24 and this sheet is adhered to the inner face of the new web 14. Again, the absorbant layer 30 has a sterlizing agent applied to it so that this sheet then acts as a sterilant in contact with the inner face of the new web 14 and, as will be seen presently, in contact with the opposing inner face of the expiring web 12. After the inner sheet is adhered to the inner face of the new web 14, the cover strips 34 are removed and the trailing end of the expiring web 12 is brought into position and adhered around the opposite face of the inner sheet 30.

Next, the cover sheet 56 is removed from the second outer sheet 28 and the layer 54 has applied to it a sterilizing agent so that when the sheet 28 is adhered to the outer face of the expiring web 12 it acts as a sterilant, sterilizing the area within which it is in contact. It will also be noted that the package is positioned with respect to the trailing end of the expiring web 12 such that the apex of the knife 52 is coincident with the transverse seal 20 which seals the end of the expiring web of bags 12.

Figure 2:
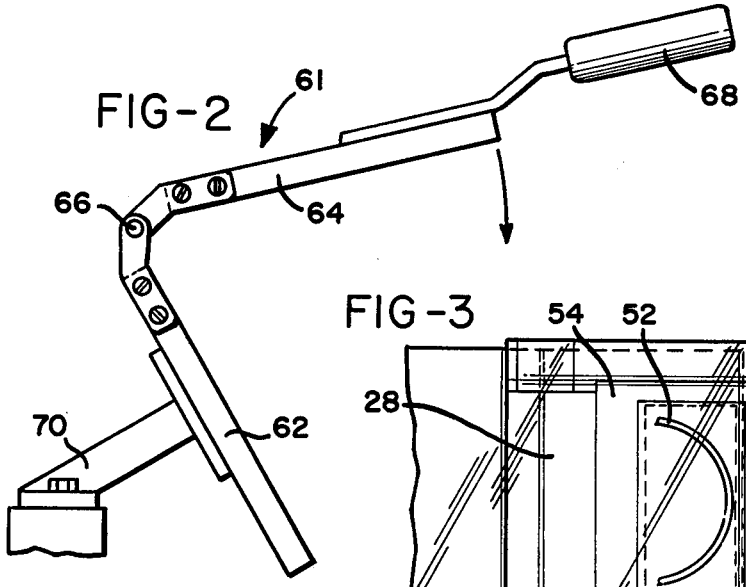
FIG. 2 is a view taken on line 2—2 of FIG. 1, illustrating the clamping station.

With the package thus engaged with the leading and trailing ends of the new and expiring webs, respectively, the entire asembly is moved to the clamping station 61, which may be of any convenient form, but which is shown in FIG. 2 as including a stationery plate 62, a movable plate 64 hinged to the plate 62 at 66, a handle 68 and a mounting bracket 70.

With the assembly at the clamping station 61 the handle 68 is moved downwardly in a direction indicated by the arrow in FIG. 2 of the drawings forcing the knife 52 through the absorbant layer 54, the outer wall of the expiring web 12, the inner wall of expiring web 12, the sterilant 30, the inner wall of the new web 14, the outer wall of the new web 14, and the absorbant layer 36.

Figure 11:
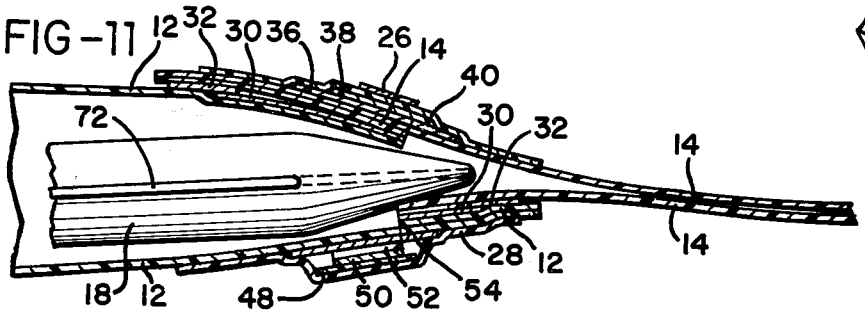
FIG. 11 is a cross sectional view through a splice made between the trailing end of an expiring web and the leading end of a new web as the filling nozzle penetrates into the new web.

This forms an opening through the walls of the new and expiring webs, permitting the nozzle 18, as seen in FIG. 11 of the drawings, to pass from the expiring web 12 into the new web 14. Because all areas of the tubes through which the openings are formed by the knife 52 are in contact with sterilants there is no danger of contamination of the system and the sterility of the interior of both the new and old webs 12 and 14 is maintained during transfer of the nozzle.

To facilitate this transfer the nozzle 18 may be provided with an air line 72 which permits a blast of sterile air to be ejected from the leading end of the nozzle to spread apart the edges of the cuts formed through the inner walls of the new and expiring webs.

Thus, the present invention provides a package for maintaining the sterility of the interiors of sterile tubes of packaging material as a sterile filling nozzle is transferred from an expiring web of bags into a new web of bags and a process for using it.

While the method and apparatus herein described constitute preferred embodiments of the invention, it is to be understood that the invention is not limited to this precise method and form of apparatus, and that changes may be made in either without departing from the scope of the invention.

What is claimed is:

1. A package for maintaining the sterility of new and expiring webs of tubular material having sterile interiors while transferring a filling nozzle from said expiring to said new web comprising:

an inner sheet adapted to contact and sterilize opposed inner surfaces of new and expiring webs of tubular material, a first outer sheet adapted to overlie and sterilize an outer surface of a new web substantially opposite said inner sheet, a second outer sheet adapted to overlie and sterilize an outer surface of an expiring web substantially opposite said inner sheet, and means carried by one of said outer sheets for forming an opening through walls of new and expiring webs with which said package is engaged to allow the sterile transfer of a filling nozzle from the expiring to the new web of tubular material.

2. The package of claim 1 further comprising:

means carried by said outer sheets for preventing the formation of an opening therethrough by said opening forming means.

3. The package of claim 2 wherein:

said means carried by said outer sheets for preventing the formation of an opening therethrough comprise anvil plates of substantially greater hardness than the material of which said inner and outer sheets are formed.

4. The package of claim 1 wherein:

said sheets include a layer of absorbant material.

5. The package of claim 4 wherein:

said sheets include pressure sensitive coated surfaces.

6. The package of claim 1 wherein:

each of said sheets includes a layer of absorbant material for receiving a liquid sterilizing agent and a pressure sensitive adhesive coated surface for adhering to said surfaces of said webs, said outer sheets carry anvil plates of substantially greater hardness than the material of which said inner and outer sheets are formed for preventing the formation of an opening therethrough by said opening forming means, and said opening forming means comprises a curved knife carried by said second outer sheet.

7. A method of maintaining the sterility of a tubular web of bags having sterile interiors while transferring a filling nozzle from a tube of material having a sterile interior to said tubular web of bags comprising the steps of:

positioning a first sterilant in contact with an outer surface of said tubular web of bags, positioning a second sterilant between and in contact with opposing inner surfaces of said tubular web of bags and said tube of material opposite said first sterilant, positioning a third sterilant in contact with an outer surface of said tube of material opposite said first sterilant, piercing walls of said tubular web of bags and said tube of material in areas thereof contacted by said sterilants to form openings through said walls, and passing said filling nozzle from said tube of material to said tubular web of bags through said openings in said walls thereof.

8. The process of claim 7 wherein said step of positioning sterilants comprises:

positioning sheets of material carrying a sterilizing agent.

9. The process of claim 7 wherein said positioning of said sterilants comprises:

adhering said sterilants to said surfaces.

10. The process of claim 7 wherein said step of piercing said walls comprises:

pressing a knife through said walls and said sterilants between plates carried by said first and third sterilants.

11. The process of claim 7 wherein:

said positioning of said sterilants comprises adhering absorbant sheets of material carrying a sterilizing agent to said surfaces, and said piercing of said walls comprises pressing a curved knife through said walls and said sterilants between plates carried by said first and third sterilants.

* * * * *